United States Patent [19]

Canelli

[11] Patent Number: 4,949,406

[45] Date of Patent: Aug. 21, 1990

[54] SINK TRAP FILTER ASSEMBLY

[76] Inventor: Giuseppe Canelli, Via Degli Aranci #21, Sorrento 80067, Napoli, Italy

[21] Appl. No.: 437,405

[22] Filed: Nov. 16, 1989

[51] Int. Cl.[5] ..... E03C 1/26

[52] U.S. Cl. ..... 4/288; 4/207; 4/286; 4/DIG. 14; 210/447

[58] Field of Search ..... 4/255–257, 4/300, 319, 207, DIG. 14, 661, 653; 15/104.33, 104.32, 104.31, 104.05, 104.061, 104.41, 242; 138/44; 210/445, 435

[56] References Cited

U.S. PATENT DOCUMENTS

| | | | |
|---|---|---|---|
| 1,394,762 | 10/1921 | Schuermann | 210/447 X |
| 1,817,376 | 8/1931 | Izquierdo | 210/447 |
| 2,690,232 | 9/1954 | Brem | 4/DIG. 14 |
| 3,552,552 | 1/1971 | Johnston | 210/447 |
| 3,834,539 | 9/1974 | Thompson | 210/447 X |
| 4,051,042 | 9/1977 | Tullier et al. | 4/DIG. 14 |
| 4,082,676 | 4/1978 | Dulger | 210/447 |
| 4,158,897 | 6/1979 | Cocherel | 4/653 X |
| 4,164,048 | 8/1979 | Kampfer et al. | 4/292 |
| 4,179,762 | 12/1979 | Barnhardt et al. | 4/207 X |
| 4,609,459 | 9/1986 | Hendrix | 210/445 X |

FOREIGN PATENT DOCUMENTS

| | | | |
|---|---|---|---|
| 1595899 | 8/1981 | United Kingdom | 4/207 |

*Primary Examiner*—Henry K. Artis
*Attorney, Agent, or Firm*—Malloy & Malloy

[57] ABSTRACT

A filter trap assembly of the type to be used in a sink or other similar plumbing facility and including an elongated vertical pipe section connected at an open end to the drain of a sink and including a closed end defining a liquid reservoir. A filter housing is disposed intermediate said open and closed ends and is structurally adapted to have a filter element removably disposed therein in interruptive relation to liquid flow passing along the length of said vertical pipe section from said open to said closed end in order to trap any solid materials therein.

12 Claims, 1 Drawing Sheet

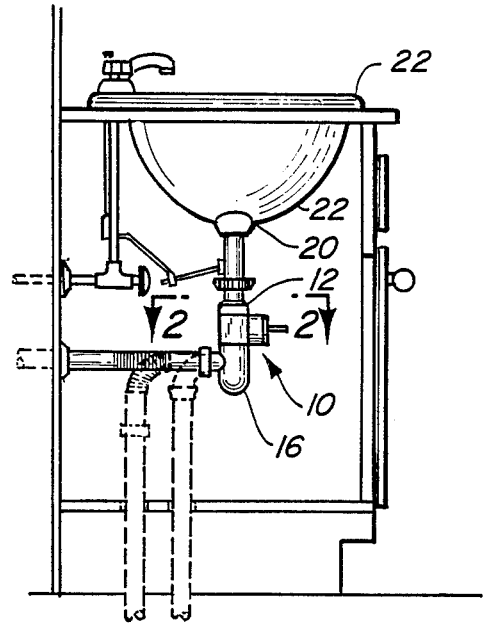
FIG. 1
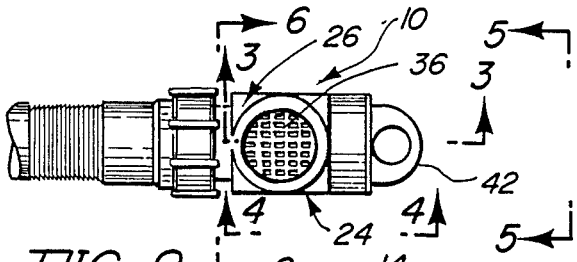
FIG. 2
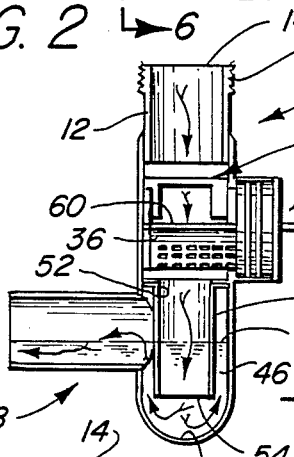
FIG. 3
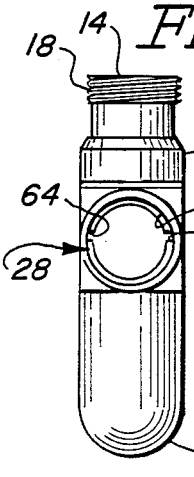
FIG. 7
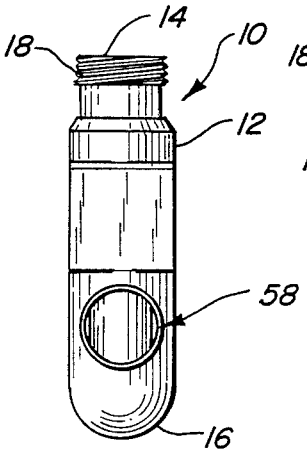
FIG. 6
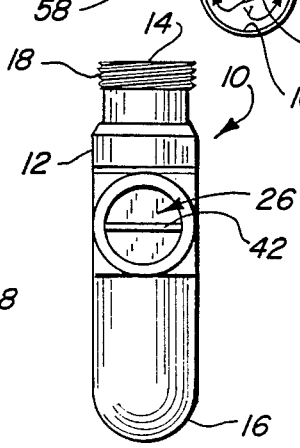
FIG. 5
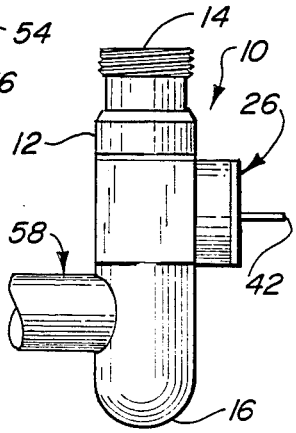
FIG. 4
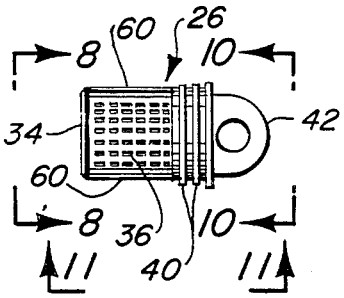
FIG. 9
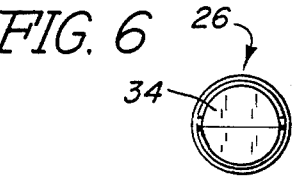
FIG. 8
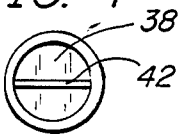
FIG. 10
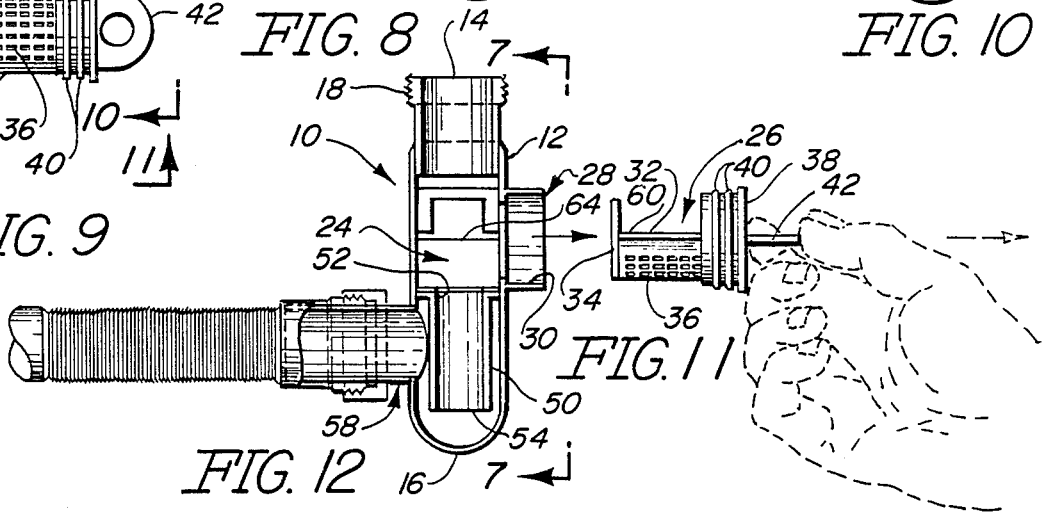
FIG. 11
FIG. 12

SINK TRAP FILTER ASSEMBLY

BACKGROUND OF THE INVENTION

1. Field of the Invention

This invention relates to a filter/trap assembly of the type used to stop or trap solid articles inadvertently passing through the drain of a sink basin, or like facility wherein the trap includes a removable filter for removable and/or retrieval of any solid material trapped therein.

2. Description of the Prior Art

Plumbing conduits of the type including drain pipes or the like are typically used to remove standing water or the like from a sink basin or similar facility. However, one problem associated with such conventional plumbing facilities is the inadvertent passage and accumulation of solid particles in some portion of the drain. In addition, it is not uncommon for certain valuable items to fall into the drain and be lost unless some trap or like facility is incorporated therein.

The prior art has made advancements in this area in an effort to provide an adequate and efficiently operable trap and/or filter mechanism associated with conventional plumbing drain pipes or the like for the purpose of removing the unwanted or inadvertently placed solid particles which pass through such drain conduits.

Examples of existing prior art devices of the type set forth herein are disclosed in the following United States patents.

Thompson, U.S. Pat. No. 3,834,539 discloses a trap for removing solid particles from a liquid system and includes a filter element disposed across a conduit at an angle sloping rearwardly with respect to the direction of liquid flow.

Barnhardt, U.S. Pat. No. 4,179,762 discloses a trap structure for drains including a U-shaped construction having a modified cylindrical base to provide visual inspection and cleaning and further which incorporates a unitary filtering and sealing device inserted within and closing one end of the cylindrical base.

Kale, U.S. Pat. No. 4,032,455 discloses a trap for sinks, laundry tubs and the like including a dip portion for retaining liquids to prevent the reverse flow of noxious gases therethrough and a closure plug for closing the opening wherein the plug is structured to support a blocking member on the interior of the dip portion of the trap for blocking flow of solid material passage therethrough. Similarly, Wojcicki, U.S. Pat. No. 4,301,554 discloses a drain trap including a J-shaped pipe section having an opening at one end and a removable tray insertable through the opening which covers the bottom of the horizontal portion on the inside thereof.

Manuel, U.S. Pat. No. 4,700,412 discloses a universal trap structure including a drain trap and a separator having a removable bowl with an open top and a center post extending upwardly through a lid member which closes the bowl in a sealed relation.

The patent to Cocherel, U.S. Pat. No. 4,158,897 discloses a siphon for lavatory basis and the like including a main body with an upper inlet opening, a lateral outlet opening and an open lower end closed by a removable socket which is disposed obliquely at an acute angle to the vertical axis of the main body.

Even in light of the advancements as evidenced by the structural assemblies in the above-noted U.S. patents, there is still a need for a filter/trap assembly to be used in combination with sinks, basins, etc. wherein particles can be readily removed in an efficient and rapid manner and wherein such an assembly can be readily adapted or fitted to an existing drain conduit structure without serious modification thereof.

SUMMARY OF THE INVENTION

The present invention is directed towards a filter and trap assembly of the type to be installed and be a part of the drain facility associated with a sink, basin, etc. More specifically, the assembly of the subject assembly includes a vertical drain pipe having an open end connected to the drain or outlet portion of the sink or basin and a closed end which defines a liquid reservoir therein. A filter housing is mounted on the interior of the vertical drain pipe between the open and closed ends and includes a base having an opening in registry with a lateral wall portion of the vertical drain pipe. A closure and attached filter means is positionable into and out of the opening associated with the filter housing for the insertion and selective removal of the filter and the closure attached thereto. The closure is such as to sealingly engage and therefore close and prevent any liquid from passing therethrough when the filter is in its operative, interruptive position relative to liquid flow passing between the open and closed ends of the vertical pipe sections.

In addition, the filter housing includes an elongated vertically oriented conduit concentrically disposed on the interior of the vertical pipe section and having one end communicating directly with the filter housing for the receiving of liquid passing therethrough from the opened end. The opposite end of the vertical conduit is disposed in spaced relation to the closed end and is submerged beneath the level of water maintained in the liquid reservoir defined by the closed end. The interior of the vertical pipe section surrounding the vertical conduit is segregated from the open end of the vertical pipe section except through the opposite, open end of the elongated vertical conduit. Therefore, any noxious odors or gases attempting to pass in a reverse direction through the outlet and drain opening will be blocked due to the existence of the liquid reservoir and the fact that the opposite end of the vertical conduit is submerged beneath the level of the liquid within the liquid reservoir defined by the closed end.

The filter structure maintained within the filter housing has an open mesh construction which is specifically dimensioned to allow liquid flow to pass therethrough but will interrupt any passage of solids therethrough. Further, the filter element is readily removable through the aforementioned entrance means formed in the lateral wall surface of the vertical pipe section.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a detailed explanation of the subject invention, reference should be had to the following description taken in connection with the accompanying drawings in which:

FIG. 1 is a side view of the assembly secured in one of two operative positions associated with a sink, basin or the like.

FIG. 2 is a top view along line 2—2 of FIG. 1 in partial cutaway showing details of the interior of the subject assembly.

FIG. 3 is a longitudinal sectional view showing interior details of the subject assembly.

FIG. 4 is an exterior side view of the embodiment of FIG. 3.

FIG. 5 is an end view taken along line 5—5 of FIG. 2.

FIG. 6 is an opposite end view taken along line 6—6 of FIG. 2.

FIG. 7 is a view along line 7—7 of FIG. 12 of the subject assembly with the filter structure removed therefrom.

FIG. 8 is an end view of the filter structure along line 8—8 of FIG. 9.

FIG. 9 is a top plan view of the filter structure as that shown in FIG. 11.

FIG. 10 is an end view along line 10—10 of FIG. 9.

FIG. 11 is a detailed exterior view of the filter structure.

FIG. 12 is an interior view of the assembly with an outlet pipe attached thereto.

Like reference numerals refer to like parts throughout the several views of the drawings.

DETAILED DESCRIPTION OF THE PREFERRED EMBODIMENT

The present invention is directed towards a filter/-trap assembly generally indicated as 10 and comprising a vertical pipe section 12 having an open end 14 and a closed end 16 oppositely disposed relative to one another. The open end is structured in terms of including proper threading or like connector means as at 18 to be secured to a drain portion 20 of a sink 22 or the like. Further, the vertical pipe section includes a filter housing generally indicated as 24 disposed on the interior thereof and specifically structured to removably secure a filter element 26 therein. The filter housing is disposed to receive liquid flow passing through the vertical pipe section 12 from the open end 14 on its way to the closed end 16. The filter housing 24 further includes an entrance means 28 in the form of an opening 30 formed in a lateral wall of the vertical pipe section 12 between the open end 14 and the closed end 16 (see FIGS. 7 and 12). The entrance means 28 as well as the interior of the filter housing 24 is specifically dimensioned and configured to receive the filter structure 26 therein and allow its easy access, insertion and removal.

The filter structure 26 includes an open face as at 32 and a closed end portion as at 34 with a filter member 36 disposed substantially transversely to and in interruptive relation to liquid flow passing between open and closed ends 14 and 16 respectively. The open end construction of the filter 36 allows liquid to pass therethrough but is dimensioned to prevent any significant solid articles from passing continuously through the drain system. The opposite end of the filter structure 26 is defined by a closure means 38 having seal means 40 formed on the exterior surface thereof to cooperate with the interior surface of the entrance 30 in order to provide a liquid tight seal and prevent leakage of liquid therefrom. A pull tab or handle means as at 42 is provided on the exterior of the closure 36 and is disposed and configured to facilitate insertion and removal therefrom as indicated primarily in FIG. 11.

As best shown in FIG. 3, the closed end 16 of the vertical pipe section 12 defines a liquid reservoir as at 46 specifically dimensioned to maintain liquid therein. The upper level therein as at 48 is below the open end of a conduit 50. The conduit may be considered part of the filter housing 24 and includes one end connected directly thereto in fluid communication therewith as at 52. The opposite or open end 54 as set forth above is disposed in submerged relation within the liquid reservoir 46. Further, the level 48 is in registry with an outlet generally indicated as 58 communicating with the interior of the vertical pipe section 12 exteriorly of the conduit 50. The presence of the liquid reservoir 46 prevents noxious odors from passing back through the interior of the vertical conduit 12 and up through the drain portion 20 of the sink 22. Further, the interior of the vertical pipe section is segregated from the open end 14 thereof at the locale where it surrounds the interiorly located conduit 50 except through the opposite or open end 54 of the conduit 50 through the liquid reservoir 46.

Other structural features include track means for accomplishing sliding, supporting engagement of the filter structure 26 on the interior of the filter housing 24. More specifically, the track means includes at least one track element 60 formed along opposite lateral edges of the filter structure 26.

These track elements 60 cooperate with an internally mounted track receiving portion defining part of the track means and indicated as 64 on FIG. 7.

Now that the invention has been described,

What is claimed is:

1. A sink trap filter assembly for use along the drain line of a sink, bathtub or like facility, said assembly comprising:

(a) a substantially vertical pipe section having an open end and a closed end oppositely disposed relative to one another, (b) said open end connected to a drain pipe section of the sink and said closed end located below said open end and defining a chamber for a liquid reservoir, (c) a filter housing including a base connected to said vertical pipe section intermediate said open and closed ends, said base having a hollow interior structure to facilitate liquid flow therethrough, (d) a filter element having an open mesh construction to allow liquid flow therethrough and cooperatively structured with said filter housing to be removably mounted on the interior of said base in interruptive relation to liquid flow between said open end and said closed end, (e) said filter housing including a conduit connected at one end to said base and extending therefrom toward said closed end on the interior of said vertical pipe section in flow-through alignment with said open end, (f) an opposite end of said conduit being open and disposed in spaced relation to the closed end of said vertical pipe section and within said chamber defining said liquid reservoir, said conduit defining a path of liquid flow from said base to said closed end, and (g) an outlet disposed below said base, between and in spaced relation to both said closed end and said conduit and in transverse relation to said vertical pipe section.

2. An assembly as in claim 1 wherein said open end of 2 said vertical pipe section communicates with said closed end only through said base and said opposite end of said conduit; said vertical pipe section disposed exteriorly of said conduit and said outlet being segregated from fluid communication with said open end of said vertical pipe section.

3. An assembly as in claim 2 wherein said opposite end of said conduit is disposed in fluid communication with said outlet through the liquid reservoir within said chamber.

4. An assembly as in claim 3 wherein said closed end defines a substantially semi-spherical configuration and an upper level of the liquid reservoir disposed within said chamber of said closed end positioned in registry with said outlet and above said opposite end of said conduit.

5. An assembly as in claim 1 wherein an upper level of the liquid reservoir within said chamber is disposed in registry with said outlet and above said opposite end of said conduit.

6. An assembly as in claim 1 wherein said outlet is disposed transversely to the length of said vertical pipe section; a discharge pipe connected to said outlet and extending outwardly therefrom and defining a path of fluid flow outwardly from said vertical pipe section.

7. An assembly as in claim 6 wherein said discharge pipe comprises an elongated configuration including a flexible section along a portion of the length thereof, said discharge pipe having one end connected to said outlet and selectively positionable in either a substantially horizontal or substantially vertical orientation relative to said vertical pipe section.

8. An assembly as in claim 1 wherein said base comprises an entrance means formed transversely in a lateral wall of said vertical pipe section for positioning of said filter element into and out of said base.

9. An assembly as in claim 8 wherein said entrance means comprises an opening dimensioned and configured to allow passage of said filter element therethrough and a closure structure removably secured in covering relation to said opening.

10. An assembly as in claim 9 wherein said filter element, said base and said entrance means are cooperatively disposed and dimensioned to selectively position and remove said filter element relative to said base in a transverse orientation relative to the length of said vertical pipe section.

11. As assembly as in claim 10 wherein said filter element comprises an elongated configuration with an open upper side and one end secured to said closure structure and movable therewith.

12. An assembly as in claim 11 further comprising track means formed on both said filter element and interior surface portions of said base for sliding movement and support of said filter element into and out of said base in a direction transverse to a direction of liquid flow from said open end to said closed end of said vertical pipe section.

* * * * *